US009969408B2

(12) United States Patent
Steger

(10) Patent No.: US 9,969,408 B2
(45) Date of Patent: May 15, 2018

(54) TROLLEY FOR CABLE TRANSPORTATION SYSTEM TRANSPORTATION UNITS AND DEPOT FOR TRANSPORTATION UNITS COMPRISING SUCH A TROLLEY

(71) Applicant: ROPFIN B.V., Leimuiden (NL)

(72) Inventor: Günther Steger, Vipiteno (IT)

(73) Assignee: LEITNER S.P.A., Vipiteno (IT)

( * ) Notice: Subject to any disclaimer, the term of this patent is extended or adjusted under 35 U.S.C. 154(b) by 209 days.

(21) Appl. No.: 14/812,402

(22) Filed: Jul. 29, 2015

(65) Prior Publication Data

US 2016/0031451 A1 Feb. 4, 2016

(30) Foreign Application Priority Data

Jul. 29, 2014 (IT) ..... MI2014A1375

(51) Int. Cl.
*B61B 9/00* (2006.01)
*B61B 12/12* (2006.01)
*B61B 3/00* (2006.01)

(52) U.S. Cl.
CPC ..... *B61B 9/00* (2013.01); *B61B 3/00* (2013.01); *B61B 12/122* (2013.01)

(58) Field of Classification Search
CPC .... B61B 3/00; B61B 3/02; B61B 7/00; B61B 7/02; B61B 9/00; B61B 10/00
See application file for complete search history.

(56) References Cited

U.S. PATENT DOCUMENTS 4,785,738 A * 11/1988 Mollet ..... B61B 12/022 104/172.4

FOREIGN PATENT DOCUMENTS

| | | |
|---|---|---|
| DE | 10 2010 017068 | 11/2011 |
| FR | 1 455 899 | 10/1966 |
| FR | 2 044 264 | 2/1971 |
| FR | 2 675 451 | 10/1992 |
| JP | H04 45173 | 4/1992 |

OTHER PUBLICATIONS

Italian Search Report and Written Opinion for Application No. IT MI2014001375 dated Mar. 26, 2015.

* cited by examiner

*Primary Examiner* — Robert J McCarry, Jr.
(74) *Attorney, Agent, or Firm* — Neal, Gerber & Eisenberg LLP

(57) ABSTRACT

A trolley for a cable transportation system transportation unit extends along a longitudinal axis and comprises a frame; a clamp supported by the frame and configured to connect the trolley to a cable; and a first and second guide which are mounted and project on opposite sides of the clamp, taper towards their respective free ends, and have respective bottom faces configured to contact the cable and respective top faces configured to define a support for at least one roller; and wherein the bottom face of the second guide comprises a first and a second portion and the second portion located at the free end and sloping upwards with respect to the first portion.

15 Claims, 2 Drawing Sheets

TROLLEY FOR CABLE TRANSPORTATION SYSTEM TRANSPORTATION UNITS AND DEPOT FOR TRANSPORTATION UNITS COMPRISING SUCH A TROLLEY

PRIORITY CLAIM

This application claims the benefit of and priority to Italian Patent Application No. MI2014A 001375, filed on Jul. 29, 2014, the entire contents of which is incorporated by reference herein.

BACKGROUND

In general, a trolley for cable transportation system transportation units extends along a longitudinal axis, and comprises a frame and a clamp supported by the frame and configured to connect the trolley to the cable. The trolley comprises a first and a second guide, which are mounted projecting from opposite sides of the clamp. The guides are tapered towards their respective free ends, and have respective bottom faces configured to be arranged in contact with the cable and respective top faces configured to define a support for a roller unit (i.e., they act as rolling tracks for each roller of the roller unit when a trolley passes beneath a roller unit). Such guides are commonly called "lifter" and have the function of facilitating the passage of the clamp beneath a roller unit arranged in contact with the top part of the cable to define a curve with a center of curvature above the cable. In the case in point, the guide upstream, with reference to the direction of travel of the trolley, progressively raises the rollers of the roller unit to enable relatively easy passage of the clamp, while the guide downstream progressively accompanies the rollers in contact with the cable. The longer the guides, the more the movement of the rollers is progressive and without impact. However, the length of the guides negatively affects the storage capacity of the depots. It should be appreciated that during periods of inactivity of the cable transportation system, it is advisable to store the transportation units in a covered depot. In such depots, the transportation units are aligned along the longitudinal axes of the trolleys and arranged along purposely provided straight tracks.

SUMMARY

The present disclosure concerns a trolley for cable transportation system transportation units.

In particular, the present disclosure concerns a trolley, which forms an integral part of a transportation unit, has the function of supporting at least one chair or car of the transportation unit, and can be moved on a rail along a predetermined track along which transportation unit travels.

One advantage of the present disclosure is to provide a trolley for a cable transportation system which is free from certain of the drawbacks of certain of the known art.

According to the present disclosure, a trolley is provided for a cable transportation system transportation unit; the trolley extending along a longitudinal axis and comprising a frame; a clamp supported by the frame and configured to connect the trolley to a cable; and a first and a second guide, which are mounted projecting from opposite sides of the clamp and tapered towards the respective free ends, and have respective bottom faces configured to be arranged in contact with the cable; and wherein the bottom face of the second guide has a first portion adjacent to the clamp and a second portion located at the free end and inclined upwards with respect to the first portion.

Thanks to the present disclosure, when the trolleys are stored in a depot along a straight track, the second guide of one trolley overlaps the first guide of an adjacent trolley, at least partially. Consequently, the trolleys can be distributed along the track with a relatively short distribution pitch less than the one dictated by the maximum size of the trolley in the direction of travel to the advantage of the storage capacity of the depot.

In particular, the first and the second guide are made of polymer material. This characteristic enables for relatively easy processing of the plastic material, which is also relatively strong and relatively lightweight.

In particular, the first and the second guide are made of an elastically deformable material. This characteristic enables the first and the second guide to resume their original configuration even after slight deformations induced by the overlapping between the first and the second guide.

According to an embodiment of the present disclosure, the second guide comprises an end portion bent upwards so as to define the first and the second portion along the bottom face.

In practice, to produce the second portion, the end of the second guide is bent upwards. This configuration can be obtained either by moulding, or by bending overcoming the elastic limit of the material of the guide.

In certain embodiments, the first guide extends from the clamp in the travelling direction of the trolley.

The first guide substantially has the function of wedging in between the cable and a roller unit.

In certain embodiments, the second guide extends from the clamp in the opposite direction to the travelling direction of the trolley. In this way, any bend does not affect the operation of the guide.

In general, the second guide of the trolley is configured to enable the first guide of a further trolley adjacent to and aligned with the trolley along the longitudinal axis to fit beneath the second guide.

The present disclosure concerns a cable transportation system transportation unit, the transportation unit comprising a trolley as described herein and a chair or a car suspended from the trolley, in which the maximum size parallel to said longitudinal axis is designated or given by the distance between the free ends of the first and second guide.

The present disclosure further concerns a depot for a cable transportation system transportation unit, the depot comprising at least one straight track, along which a plurality of transportation units are aligned as described herein, and in which the distance between the transportation units parallel to said longitudinal axis is less than the maximum size of each transportation unit.

Additional features and advantages are described in, and will be apparent from the following Detailed Description and the Figures.

BRIEF DESCRIPTION OF THE DRAWINGS

Further characteristics and advantages of the present disclosure will appear clear from the following description of a non-limiting implementation example thereof, with reference to the Figures of the accompanying drawings, in which.

DETAILED DESCRIPTION

Figure 1:
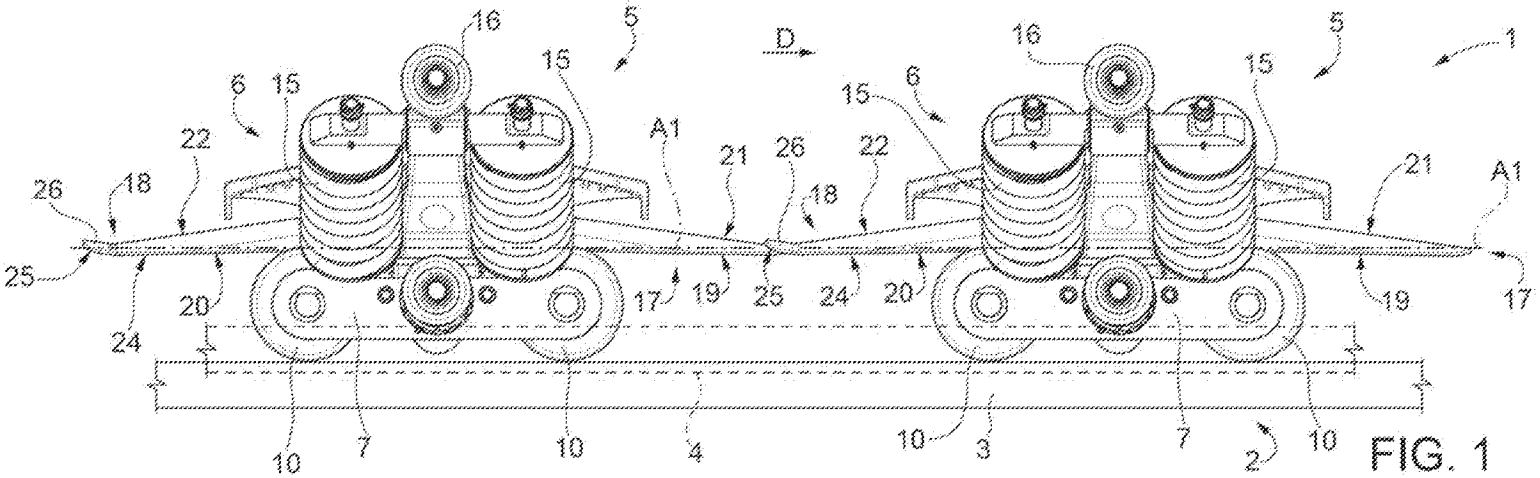
FIG. 1 is a lateral elevation view, with parts removed for clarity, of a depot of a cable transportation system and transportation units provided with trolleys according to the present disclosure.

Referring now to the example embodiments of the present disclosure illustrated in FIGS. 1 to 6, with reference to FIG. 1, the number 1 indicates as a whole a depot of a cable transportation system.

The depot 1 comprises a straight track 2, in this case defined by two parallel rails 3 and 4, and configured to support transportation units 5 of the cable transportation system during the storage period. To simplify illustration of the depot 1, the case illustrated shows one single track 2 of the depot 1, it being understood that the depot 1 can comprise a plurality of tracks, generally parallel to one another. Each transportation unit 5 comprises a trolley 6; and a chair or a car (not illustrated in the drawings) configured to be suspended from the trolley 6. Each trolley 6 extends along a longitudinal axis A1 parallel to the direction of travel D of the trolley 6 and comprises a frame 7 and a clamp 8 supported by the frame 7 and configured to connect the trolley 6 to a cable 9 (as illustrated by the broken lines in FIGS. 4 and 5).

Figure 3:
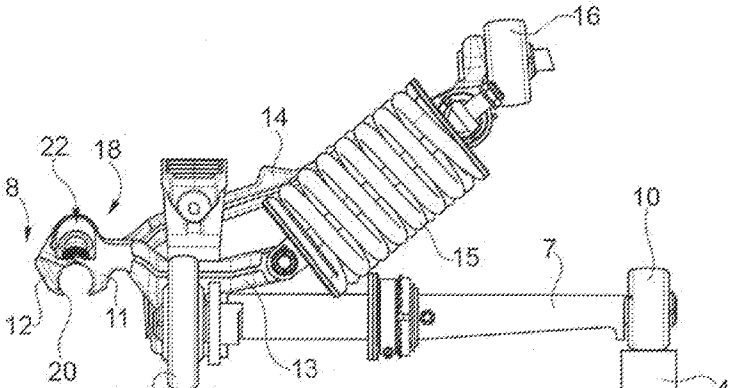
FIG. 3 is an elevation view, with parts removed for clarity and on an enlarged scale, of the depot and of a transportation unit illustrated in FIG. 1.

As better illustrated in FIG. 3, the trolley 6 comprises rollers 10 mounted on the frame 7 to roll along the rails 3 and 4. The clamp 8 comprises two jaws 11 and 12 which can be operated between a closed position (illustrated in the drawings) and an open position (not illustrated in the drawings) utilizing respective arms 13 and 14, a spring 15 and a roller 16 configured to cooperate with a cam (not illustrated in the drawings). It should be appreciated that in certain embodiments, the jaw 11 is fixed, whereas the jaw 12 is mobile. The jaws 11 and 12 define an opening facing downwards both in the open position and in the closed position.

With reference to FIG. 1, the trolley 6 comprises two guides 17 and 18, which are mounted projecting from opposite sides of the clamp 8 and tapered towards the respective free ends. The guides 17 and 18 are substantially parallel to the axis A1. In particular, the guide 17 extends from the clamp 8 in the direction of travel of the trolley 6, while the guide 18 extends in the opposite direction to the direction of travel of the trolley 6.

The guides 17 and 18 are fixed to the fixed jaw 11. The guides 17 and 18 are particularly relatively long and are substantially of equal length. The distance between opposite ends of the guides 17 and 18 defines the maximum size of the trolley 6 parallel to the direction of travel D. In the case of the present disclosure, the guides 17 and 18 also define the maximum size in the direction of travel D of the entire transportation unit 5.

Figure 5:
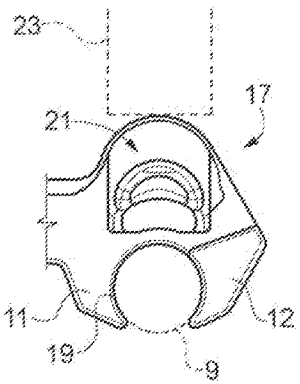
FIGS. 4 and 5 are elevation views, with parts removed for clarity, of a detail of the transportation unit of FIG. 3.
Figure 4:
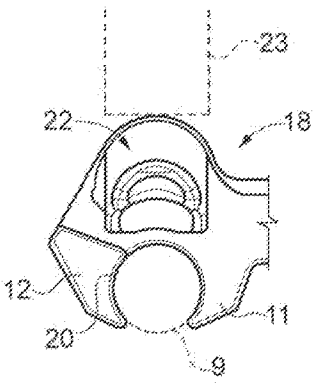

The guides 17 and 18 have respective bottom faces 19 and 20 configured to be arranged in contact with the cable 9 (illustrated by broken lines in FIGS. 4 and 5), and respective top faces 21 and 22 configured to define respective supports for a roller unit of which a roller 23 is illustrated by broken lines in FIGS. 4 and 5.

The bottom face 19 of the guide 17 is straight and substantially parallel to the axis A1 and, in use, to the cable 9 (FIG. 5). The bottom face 20 of the guide 18 has two portions 24 and 25 characterised by a different inclination with respect to the axis A1. The portion 24 is adjacent to the clamp 8 and is substantially parallel to the axis A1 and, in use, to the cable 9 (FIG. 4), while the portion 25 is an end portion adjacent to the portion 24 and inclined upwards with respect to the portion 24 as better illustrated in FIG. 2.

In the case illustrated, the guide 18 has an end portion 26 bent upwards so as to define the portion of face 25 angled with respect to the portion of face 24.

Figure 6:
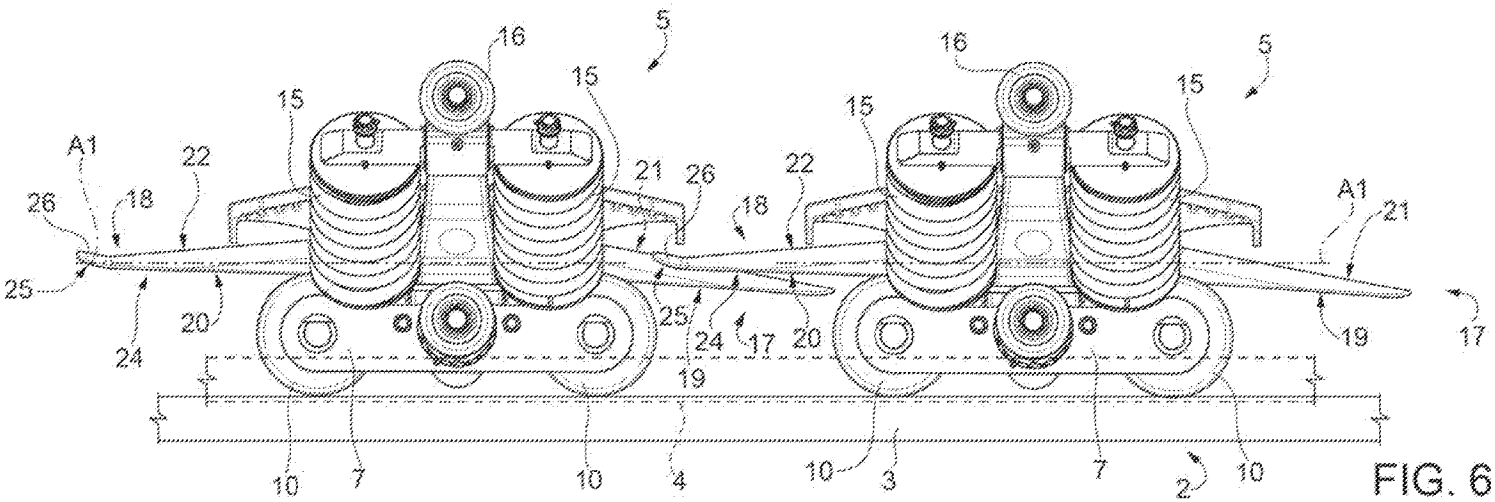
FIG. 6 is a lateral elevation view, with parts removed for clarity, of the depot of FIG. 1 in which the transportation units are arranged at a reduced pitch.

The portion of face 25 enables the guide 17 to fit beneath the guide 18 for almost the entire length of the guides 17 and 18 thanks to a slight deformation of the guides 17 and 18 as shown in FIG. 6.

The guides 17 and 18 are made of a polymer material adapted to enable relatively small elastic deformations.

Figure 2:
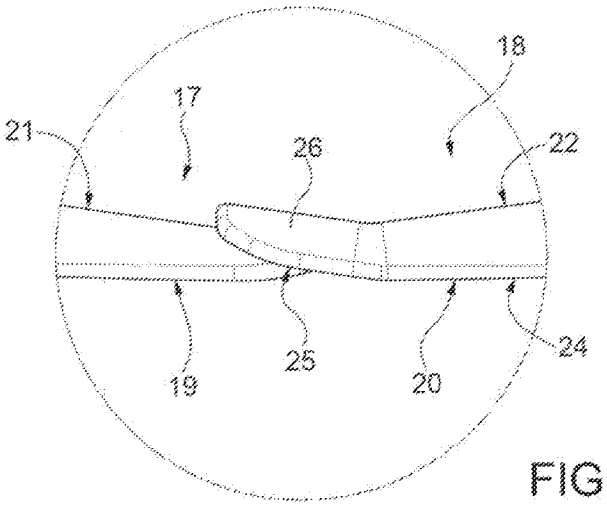
FIG. 2 is a lateral elevation view, on an enlarged scale and with parts removed for clarity, of a detail of FIG. 1.

In use and with reference to FIG. 1, when the transportation units 5 are arranged in the depot 1, they are aligned with one another along at least one straight track; in this phase the trolleys 6 rest on rails 3 and 4 and are moved by travel devices (not illustrated in the drawings) which push the trolleys 6 against one another. Due to the particular configuration of the guides 17 and 18, the guide 17 of a trolley 6 fits beneath the guide 18 of the adjacent trolley 6 as shown in FIG. 2. A further movement of the travel device (not illustrated in the drawings) determines partial overlapping between the guides 17 and 18 of the two adjacent trolleys 6 as shown in FIG. 6.

Lastly it is evident that modifications and variations can be made to the subject of the present disclosure without departing from the scope of the attached claims. That is, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A cable transportation system transportation unit trolley comprising:

a frame;

a clamp supported by the frame and configured to be connected to a cable;

a first guide mounted on and projecting from a first side of the clamp, said first guide including a straight bottom face extending in a first direction parallel to a longitudinal axis and configured to contact the cable; and a second guide mounted on and projecting from a second, opposite side of the clamp, said second guide including a bottom face which includes:

a first straight bottom face portion adjacent to the clamp and extending in a second direction parallel to the longitudinal axis, said first straight bottom face portion configured to contact the cable, and a second bottom face portion located at a free end of the second guide, said second bottom face portion sloping upwards with respect to the first bottom face portion.

2. The cable transportation system transportation unit trolley of claim 1, wherein a portion of said first guide tapers toward a free end of the first guide.

3. The cable transportation system transportation unit trolley of claim 2, wherein a portion of said second guide tapers toward the free end of the second guide.

4. The cable transportation system transportation unit trolley of claim 1, wherein the first guide and the second guide are each made of a polymer material.

5. The cable transportation system transportation unit trolley of claim 1, wherein the first guide and the second guide are each made of an elastically deformable material.

6. The cable transportation system transportation unit trolley of claim 1, wherein the second guide includes an end portion bent upwards to define the second bottom face portion of the second guide.

7. The cable transportation system transportation unit trolley of claim 1, wherein the first direction comprises a direction of travel.

8. The cable transportation system transportation unit trolley of claim 7, wherein the second direction comprises an opposite direction to the direction of travel.

9. The cable transportation system transportation unit trolley of claim 1, wherein the second guide is configured to enable the first guide of another cable transportation system transportation unit trolley to fit beneath the second bottom face portion of the second guide, said other cable transportation system transportation unit trolley being adjacent to and aligned with the cable transportation system transportation unit trolley along the longitudinal axis.

10. A cable transportation system transportation unit comprising:

a trolley including:

a frame, a clamp supported by the frame and configured to be connected to a cable, a first guide mounted on and projecting from a first side of the clamp, said first guide including a straight bottom face extending in a first direction parallel to a longitudinal axis and configured to contact the cable, a second guide mounted on and projecting from a second, opposite side of the clamp, said second guide including a bottom face which includes:

a first straight bottom face portion adjacent to the clamp and extending in a second direction parallel to the longitudinal axis, said first straight bottom face portion configured to contact the cable, and a second bottom face portion located at a free end of the second guide, said second bottom face portion sloping upwards with respect to the first bottom face portion; and one of a chair and a car suspended from the trolley.

11. The cable transportation system transportation unit of claim 10, wherein a portion of said first guide of the trolley tapers toward a free end of the first guide.

12. The cable transportation system transportation unit of claim 11, wherein a portion of said second guide of the trolley tapers toward the free end of the second guide.

13. A cable transportation system transportation unit depot comprising:

at least one straight track; and a plurality of transportation units aligned along the at least one straight track, wherein a distance, parallel to a longitudinal axis, between two of the transportation units is less than a maximum length, parallel to the longitudinal axis, of each of the two transportation units, each transportation unit including:

a trolley including:

a frame;

a clamp supported by the frame and configured to be connected to a cable;

a first guide mounted on and projecting from a first side of the clamp, said first guide including a straight bottom face extending in a first direction parallel to the longitudinal axis and configured to contact the cable;

a second guide mounted on and projecting from a second, opposite side of the clamp, said second guide including a bottom face which includes:

a first straight bottom face portion adjacent to the clamp and extending in a second direction parallel to the longitudinal axis, said first straight bottom face portion configured to contact the cable, and a second bottom face portion located at a free end of the second guide, said second bottom face portion sloping upwards with respect to the first bottom face portion, and one of a chair and a car suspended from the trolley.

14. The cable transportation system transportation unit depot of claim 13, wherein for each transportation unit, a portion of said first guide of the trolley tapers toward a free end of the first guide.

15. The cable transportation system transportation unit depot of claim 14, wherein for each transportation unit, a portion of said second guide of the trolley tapers toward the free end of the second guide.

* * * * *